US006679404B2

(12) United States Patent
Brandt

(10) Patent No.: US 6,679,404 B2
(45) Date of Patent: Jan. 20, 2004

(54) TOOL-TOTING DEVICE FOR CONNECTION TO A BELT

(76) Inventor: Mark R. Brandt, 604 Superior Ave., Dayton, OH (US) 45047

( * ) Notice: Subject to any disclaimer, the term of this patent is extended or adjusted under 35 U.S.C. 154(b) by 89 days.

(21) Appl. No.: 09/796,246

(22) Filed: Feb. 28, 2001

(65) Prior Publication Data

US 2002/0117521 A1 Aug. 29, 2002

(51) Int. Cl.[7] ..... A45F 5/00

(52) U.S. Cl. ..... 224/247; 224/232; 224/234; 224/240; 224/670; 224/671; 224/672; 224/673; 224/904

(58) Field of Search ..... 224/247, 904, 224/670, 671, 672, 673, 240, 232, 234; 24/3.12

(56) References Cited

U.S. PATENT DOCUMENTS

| | | | | | |
|---|---|---|---|---|---|
| 1,488,594 | A | * | 4/1924 | Gaschke | 24/543 |
| 2,117,937 | A | * | 5/1938 | Brownell | 224/232 |
| 2,387,900 | A | * | 10/1945 | Hartwell | 224/197 |
| 2,618,419 | A | | 11/1952 | Vanish | |
| 2,893,615 | A | * | 7/1959 | Couper | 224/193 |
| D248,066 | S | | 6/1978 | Hillinger | |
| D248,797 | S | | 8/1978 | Sanders | |
| 4,372,468 | A | | 2/1983 | Harvey | |
| 4,408,706 | A | | 10/1983 | Hurley | |
| D297,608 | S | | 9/1988 | House | |
| 4,962,873 | A | | 10/1990 | Schattel | |
| 4,974,764 | A | * | 12/1990 | Cantwell | 224/269 |
| 5,429,289 | A | * | 7/1995 | Lamson et al. | 119/769 |
| 5,501,379 | A | | 3/1996 | Munoz | |
| 5,743,451 | A | | 4/1998 | Kahn | |
| 6,102,264 | A | * | 8/2000 | Redzisz | 224/197 |
| 6,269,993 | B1 | * | 8/2001 | Ebejer et al. | 224/269 |

* cited by examiner

*Primary Examiner*—Gregory Vidovich
*Assistant Examiner*—Maerena W. Brevard
(74) *Attorney, Agent, or Firm*—R. William Graham

(57) ABSTRACT

A tool-toting device for connection to a belt to be worn about the waist of a tradesman for the purpose of carrying a tool of a type having an elongated handle and angled or transverse head portion includes a support backing associatable as part of the belt; and a tool support spring clip having a first generally horizontally disposed side-spring clip portion having a first and second end and connected to the support backing. Also, provided is a second generally horizontally disposed side-spring clip portion having a first and second end and which is laterally spaced from the first generally horizontally disposed side-spring clip portion with the respective first ends and second ends generally adjacent to one another, an arcuate spring clip portion interconnecting the first ends and configured with a sufficient spring force constant to bias the second end of the second horizontally disposed side-spring clip portion toward the support backing thus forming an enclosed tool holding area for the handle whereby insertion of the handle may be easily inserted and removed therethrough by applying an opening force in a manner that the second end of the second horizontally disposed side-spring clip portion displaces away from the support backing.

6 Claims, 2 Drawing Sheets

TOOL-TOTING DEVICE FOR CONNECTION TO A BELT

BACKGROUND OF THE INVENTION

1. Field of the Invention

This invention is directed to a tool-toting device for connection to a belt for a trades person, such as a carpenter or electrician, fisherman, hunter, for conveniently carrying tools, such as a prybar, hammer, fishing pole, bow or the like.

2. Related Art

Tool-toting devices for connection to a belt bags and/or belt-supported pouches for carrying nails, screws, bolts, and tools are well known in the industry. While many devices exist, there continues to be a need for more conveniently carrying one's tools on one's person.

Tools like prybars, hammers and hatchets which have elongated handles and angled or transversely extending head pieces present problems because of their particular handle and head configurations. Carrying devices for hammers and hatchets have ranged from simple loops in one's work pants for the insertion of the elongated handle therethrough to specially designed metal and/or leather holsters in which the head of the tool is secured. For comfort and convenience, various devices have been developed which provide for a pivotal mounting of the tool on the user's waist.

One type of loop provided for a horizontally disposed closed tool carrying loop which is pivotally mounted on a pad suspended from the wearer's waistband. Still another type of loop provided for a gate piece which is pivotal to swing inwardly to permit the insertion of the handle of the hammer or hatchet. While these devices have aided one's ability to carry a hammer or hatched due to their design, they have remained relatively impractical for carrying a prybar. It would also be advantageous to provide a tool tote which adds a safety feature by providing same point of entry and removal.

It would be highly desirable if one could develop a device which provided the convenience of securing elongated tool such as a prybar at the wearer's waistband in a manner which also facilitated the securement of the tool within the device in such a manner to ease the insertion/removal thereof and minimize the diversion of attention required for the task. With such a device, the user would not only have a convenient means for carrying the prybar on his person but would be provided with a device so convenient it would always be at one's side when needed. Such a device is disclosed herein.

BRIEF SUMMARY OF THE INVENTION

Briefly, the present invention is directed to a tool-toting device for connection to a belt for a trades person adapted to be suspended from the user's waist for easy insertion and removal supporting a prybar or like tool thereon which provides a spring-clip securement of the tool to the carrying device.

It is the principal object of the present invention to provide an improved tool carrier for prybars and/or tools of quasi configuration.

It is another object of the present invention to provide a device for carrying hammer-like tools which allows for simple side insertion and removal of the tool into the device and securement of the tool therein.

It is a still further object of the present invention to provide a device for carrying such tools which is of simple construction and easy to manufacture.

It is an object to provide a tool-toting device which can be used for left or right handed use.

It is yet another object to provide a device for toting equipment on one's belt.

Accordingly, the invention is directed to a tool-toting device for connection to a belt to be worn about the waist of a tradesman for the purpose of carrying a tool of a type having an elongated handle and angled or transverse head portion. The tool include a support backing associatable as part of the belt, and a tool support spring clip having a first generally horizontally disposed side-spring clip portion having a first end and second end and which is connected to the support backing A second generally horizontally is disposed side-spring clip portion having a first and second end and which is laterally spaced from the first generally horizontally disposed side-spring clip portion with the respective first ends and second ends generally adjacent to one another. An arcuate spring clip portion interconnects the first ends and is configured with a sufficient spring force constant to bias the second end of the second horizontally disposed side-spring clip portion toward the support backing thus forming an enclosed tool holding area for the handle whereby insertion of the handle may be easily inserted and removed by applying an opening force in a manner that the second end of the second horizontally disposed side-spring clip portion displaces away from the support backing. The spring clip portion can be reversibly connectable to the support backing.

These and other objects and advantages of the present invention will become apparent from the detailed description taken in conjunction with the accompanying drawings.

DETAILED DESCRIPTION OF THE INVENTION

Figure 1:
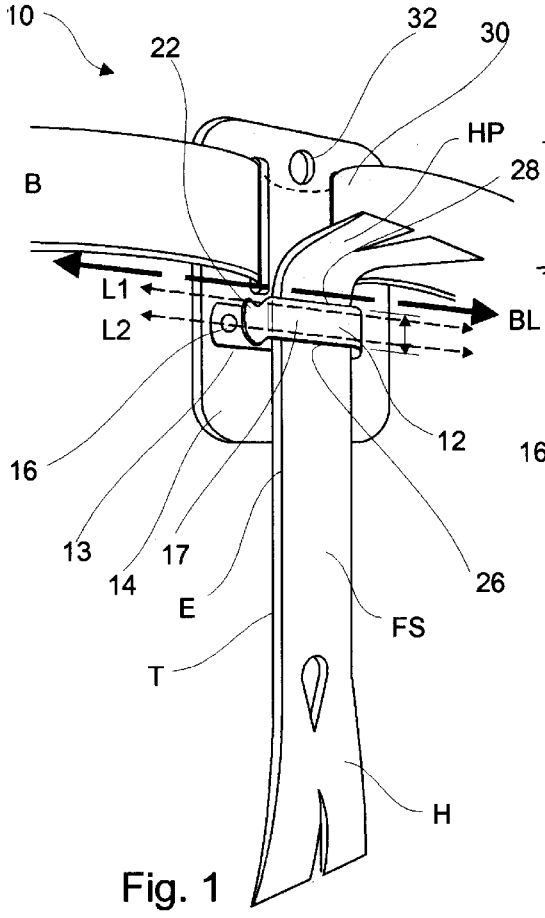
FIG. 1 is a perspective view of the present invention.

Referring now in detail to the drawings, the tool holder 10, 10' and 10" are shown by way of example configurations in FIGS. 1–2, FIGS. 3–4 and FIGS. 5–6, respectively, of the present invention. For purposes of simplifying redundancy, parts of similar nature mentioned in the discussion of the first embodiment are intended to be part of the disclosure of the second and third embodiments.

The tool 10 is comprised of a tool support spring clip 12 which, in the embodiment shown, is mounted to a support backing 14 (pad) and has a horizontally disposed side-spring clip portion 13 connected to the pad 14 in this regard. The pad 14 can be of pliant material such as leather or plastic or rigid, such as metal and secured to the portion 13 by means of rivets 16. The support spring clip 12 defines a horizontally disposed side-spring clip portion 17 which is laterally disposed from the side-spring clip portion 13 and integrally connected at one of their respectively adjacent ends by a generally arcuate spring clip portion 20. The spring clip 12 can be made of metal, plastic, composites thereof The horizontally disposed side-spring clip portion 17 terminates in a curved portion 22 which is here shown as an inwardly extending in contact with the horizontally disposed side-spring clip portion 13. The arcuate spring clip portion 20 is formed in a manner to have a sufficient spring force constant causing the curved portion 22 to be normally biased into contact with the side-spring clip portion 13.

Thus, together the portions 13, 17, 20 and 22 circumscribe a tool holding area 24 for carrying a tool T here shown to be a prybar, but could be other quasi like conllgured tools as previously described having an elongated handle and angled or transverse head portion. The area 24 defined by the spring clip 12 as shown preferably includes a relatively wide flat surface 26 as shown between the vertical arrows in FIGS. 1 and 3. The flat surface 26 has been found to be very useful in retaining tools using the configuration of the present invention. For example, the flat surface 26 provides at least two horizontally displaced lines of contact L1 and L2 around the handle of the tool T which works particularly well in holding the tool T, such as a prybar having a head terminating in a slotted opening to remove a nail. It is understood like flat surface 26' exists on portions 17'. Further, the spring-clip 12 easily permits removal and insertion of the tool T without the need to raise one's arm to slide the tool T in and out of device 10. This can be quite helpful to the tradesman when working in tight places.

A belt B is commonly worn generally horizontally circumferentially about the waist of a tradesman for the purpose of carrying the tool T. The tool T has an elongated handle H with a flat surface FS and a transverse head portion HP extending outward from the handle H at a generally uniform bend along a line BL generally perpendicular to an edge E of the handle H. The upper edge 28 of generally horizontally disposed side-spring clip portion 17 is configured to remain generally parallel with respect to the belt B such that when the handle H is held by side-spring clip portion 17, the upper edge 28 extends along the bend of the handle H to maintain the head portion HP above the edge 28 and in a manner such that the handle H is maintained generally perpendicular to the upper edge 28 thus providing the tool T in an upright position.

Figure 3:
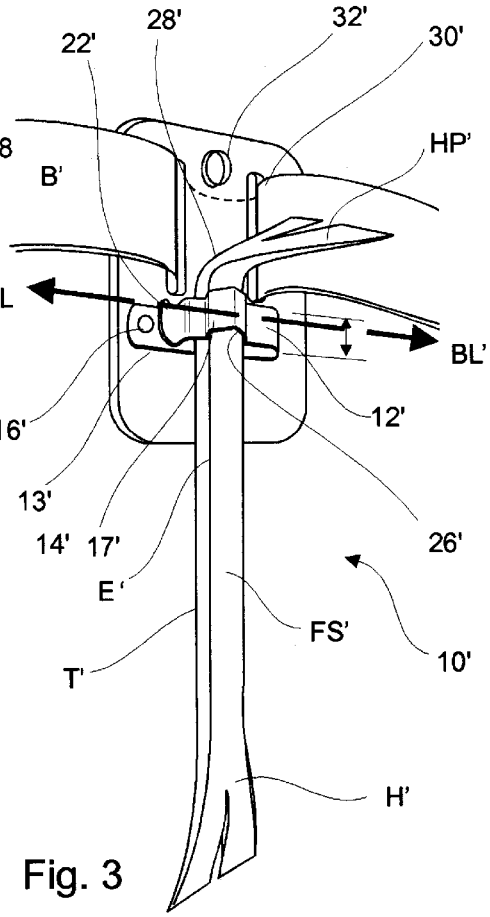
FIG. 3 is a perspective view of another embodiment of the present invention.
Figure 2:
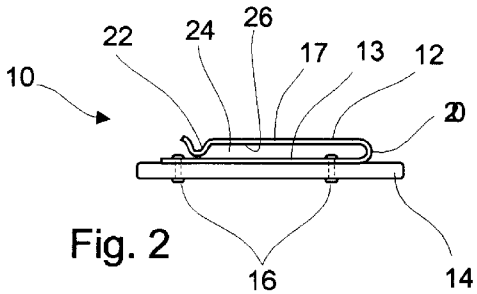
FIG. 2 is a end view of FIG. 1.
Figure 4:
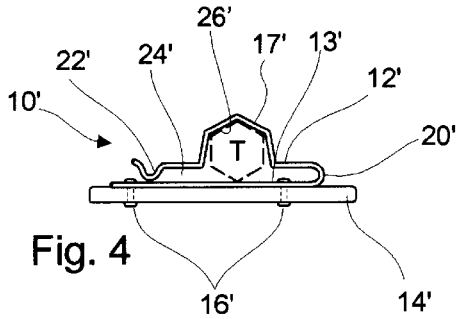
FIG. 4 is a end view of FIG. 3.

The spring clip 12 is generally "U"-shaped as shown in FIG. 1 and 2. However, other configurations such as that of FIGS. 3 and 4 are possible and which have been configured to certain geometry of a handle of the tool T' The tool T is supported by its head portion resting on an upper edge 28 of the support spring clip 12. It is preferable that the holding area 24 defines a pair of surfaces 26, 27 (here shown to be relatively flat) which oppose the complimentary formed handle surfaces of the tool T.

The pad 14 to which the tool support spring clip 12 is mounted is provided with slots 30 for securement of the pad 14 to the user's waist belt. A central upper aperture 32 can be provided in the pad 14 to hang the device 10 from a nail or hook near a workbench. This configuration of pad 14 is illustrative of a type of the support for attachment to the spring clip 12

Figure 5:
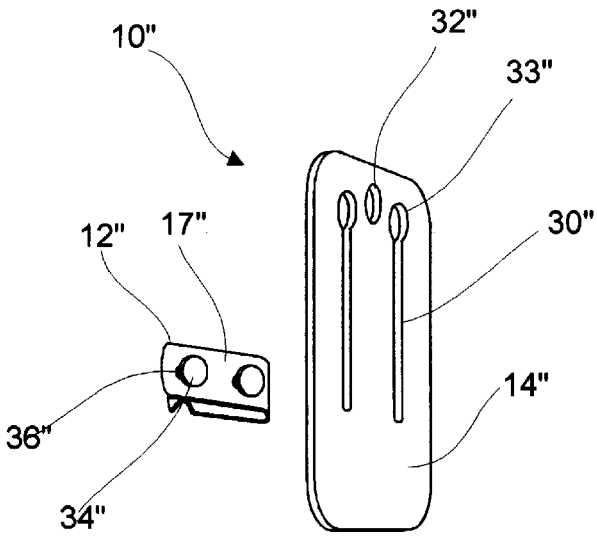
FIG. 5 is a perspective view of yet another embodiment of the present invention.
Figure 6:
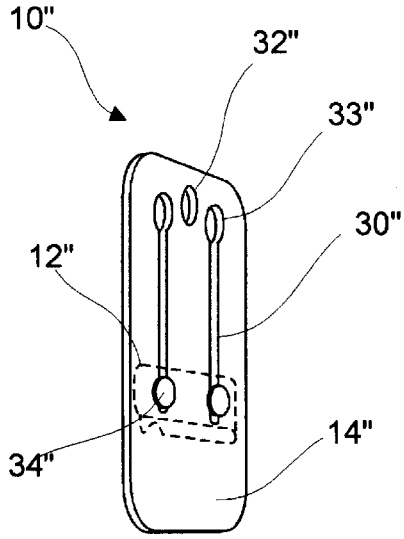
FIG. 6 is a end view of FIG. 5.
Figure 7:
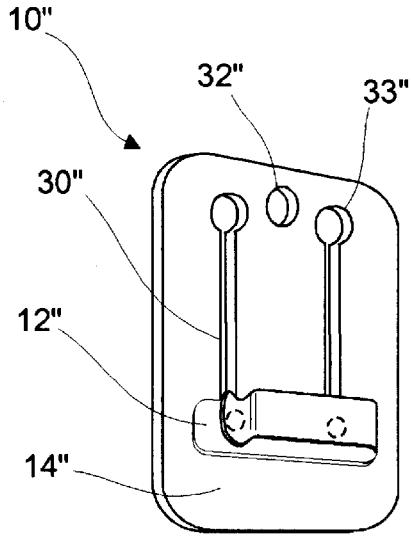
FIG. 7 is a perspective view of the embodiment in FIG. 5.
Figure 8:
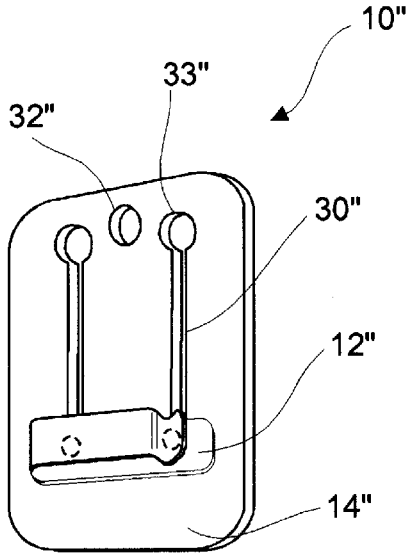
FIG. 8 is another perspective view of the embodiment in FIG. 5.

As for FIGS. 5 and 6, the device 10" here shows a reversible aspect of the spring clip 12" Slots 30" are formed with a keyhole portion 33" which permit a retaining head 34" to pass therethrough while a remaining lower narrow portion of the slot 30" precludes the head 34" from passing therethrough. The retaining head 34" extends from a retention neck 36" which in turn extends from a back of the first horizontally disposed side-spring clip portion 17". In this embodiment, the clip 12" can be removably connected and reversibly positioned and slid into a seated position at the bottom of the slots 30".

The above described embodiments are set forth by way of example and is not for the purpose of limiting the present invention. For example, the device of the present application may have application for carrying other equipment as well as used in other fields, such as the sporting goods industry. It will be readily apparent to those skilled in the art that obvious modifications, derivations and variations can be made to the embodiments without departing from the scope of the invention Accordingly, the claims appended hereto should be read in their full scope including any such modifications, derivations and variations.

What is claimed is:

1. A tool-toting device and tool for connection to a belt which is commonly worn generally horizontally circumferentially about the waist of a tradesman which comprises:

a tool having an elongated handle with a flat surface and a substantially transverse head portion extending outward from said flat surface of said handle at a generally uniform bend, said head terminating in a slotted opening;

a support backing connectable as part of the belt having a pair of laterally spaced generally vertically slot surfaces to receive the belt; and a tool support spring clip having a first side-spring clip portion having a first end and second end and which is connected to said support backing, a second generally and parallel horizontally disposed side-spring clip with respect to the belt having a first end and second end and which is laterally spaced from said first side-spring clip portion and with said respective first ends generally adjacent to one another, and said second spring-clip portion having a flat surface for disposal adjacent said flat surface of said handle, said flat surface of said spring clip surface being part of a pair of surfaces of said device which oppose said flat surface of said handle and are of a complementary configuration thereto and form a tool holding area, an arcuate spring clip portion interconnecting said first ends and configured with a sufficient spring force constant to bias said second end of said second horizontally disposed side-spring clip portion toward said support backing thus forming said enclosed tool holding area for said handle whereby insertion of said handle may be easily inserted and removed by applying an opening force in a manner that said second end of said second horizontally disposed side-spring clip portion displaces the same away from the support backing, and wherein said second generally horizontally disposed side-spring clip portion has an upper edge which is configured to remain generally parallel with respect to the belt such that when the handle is held by said second generally horizontally disposed side-spring clip portion, said upper edge extends along said bend of said handle to maintain said head above said edge and in a manner such that said handle is maintained generally perpendicular to said upper edge thus providing said tool in an upright position.

2. The tool-totng device and tool of claim 1, wherein said first side-spring clip portion is fixedly connected to said support backing.

3. The tool-toting device and tool of claim 1, wherein said pair of surfaces include a pair of displaced horizontal lines of contact which extend around the handle of said tool.

4. The tool-toting device and tool of claim 1, wherein said support spring clip is removably connectable to said support backing.

5. The tool-toting device and tool of claim 1, wherein said support backing includes a pair of laterally spaced generally vertically longitudinally spaced slot surfaces and said first generally horizontally disposed side-spring clip portion includes a pair of outwardly extending retention members laterally spaced from another and configured to be inserted through said slot surfaces in a manner to retain said support spring clip in said generally horizontal position and wherein said support spring clip is removably connectable to said support backing.

6. The tool-toting device and tool of claim 5, wherein said retention members include a retention neck and a retention head and said slot surfaces include a wider opening at a top thereof to permit a head of said retention members to pass therethrough and a narrow lower portion which permits said retention neck to pass therethrough while preventing said retention head from passing through said narrow lower portion.

* * * * *